US006497640B2

(12) United States Patent
Loft et al.

(10) Patent No.: US 6,497,640 B2
(45) Date of Patent: Dec. 24, 2002

(54) ARM EXERCISING DEVICE

(76) Inventors: Soren A. Loft, 2208 S. Fairgreen Ave., Monrovia, CA (US) 91016; Victor Konovalov, 228 Calle Descanso, Walnut, CA (US) 91789; Richard L. Rasmussen, 1841-A Mayflower Ave., Monrovia, CA (US) 91016

( * ) Notice: Subject to any disclaimer, the term of this patent is extended or adjusted under 35 U.S.C. 154(b) by 0 days.

(21) Appl. No.: 09/859,349

(22) Filed: Aug. 22, 2001

(65) Prior Publication Data

US 2002/0013201 A1 Jan. 31, 2002

Related U.S. Application Data

(62) Division of application No. 09/047,505, filed on Mar. 25, 1998, now Pat. No. 6,241,643.

(51) Int. Cl.[7] ..... A63B 21/015

(52) U.S. Cl. ..... 482/115; 482/114

(58) Field of Search ..... 482/44–46, 72, 482/79, 80, 114, 115, 117, 118, 119

(56) References Cited

U.S. PATENT DOCUMENTS

| | | | | | |
|---|---|---|---|---|---|
| 3,211,453 | A | * | 10/1965 | Williams | 272/68 |
| 4,799,674 | A | * | 1/1989 | Ochab | 272/123 |
| 5,277,682 | A | * | 1/1994 | Chen | 482/114 |
| 5,487,709 | A | | 1/1996 | Froelich, Sr. et al. | |
| 5,634,871 | A | * | 6/1997 | Froelich, Sr. et al. | 482/46 |
| 5,655,998 | A | | 8/1997 | Yu | |
| 6,139,476 | A | * | 10/2000 | Gallant | 482/114 |

* cited by examiner

*Primary Examiner*—Justine R. Yu
(74) *Attorney, Agent, or Firm*—Edgar W. Averill, Jr.

(57) ABSTRACT

An arm exercising device for strengthening a user's biceps and triceps. The device has an upper arm support platform which is attached to the user's upper arm. The upper arm platform is hinged to a hand driven arm. The hand driven arm holds a handle so that the handle can slide along the hand driven arm as the exerciser pulls and pushes the hand driven arm with respect to the upper arm platform. Friction is provided at a pivot point between these two members so that the user's bicep is exercised during the pulling in of the hand driven arm and the tricep is exercised as the hand driven arm is pushed outwardly. The device can also be attached between a user's chest and an arm and used to exercise deltoid and lateral muscles.

7 Claims, 4 Drawing Sheets

ARM EXERCISING DEVICE

CROSS REFERENCE TO RELATED APPLICATION:

This application is a divisional of application Ser. No. 09/047,505 filed Mar. 25, 1998, now U.S. Pat. No. 6,241,643.

BACKGROUND OF THE INVENTION

The field of the invention is exercising devices and the invention relates more particularly to exercising devices for exercising a user's biceps, triceps, deltoids and laterals.

Numerous devices have been devised for arm exercising. One such device is shown in U.S. Pat. No. 5,042,799. This device utilizes a spring loaded pair of arms pivoted at the user's elbow. Resistance is created by a spring. As one exercises one's arm the spring only works the user's biceps and the device must be reconfigured to exercise a user's triceps.

U.S. Pat. No. 4,718,665 shows an exercising device which utilizes a breaking system using planetary gears. The device is designed to contact the limbs adjacent a joint and because of the positioning of collars adjacent the joint would exert substantial strain against the limbs. This is because the collars are very close to the joints.

U.S. Pat. No. 5,454,769 shows a wrist and forearm exercising apparatus which utilizes a spring and pivoted handle. It is limited to the exercising of a forearm.

SUMMARY OF THE INVENTION

It is an object of the present invention to provide a lightweight device for exercising a user's biceps, triceps, deltoid and lateral muscles.

The present invention is for an arm exercising device for strengthening a user's biceps and triceps which device can be placed in an alternative position and used to exercise a user's deltoid and lateral muscles. The device has an upper arm support platform which is attached to a user's upper arm against a user's tricep muscle. A hand driven assembly is pivotally attached to the upper arm support platform. A handle is attached to the hand driven assembly and the handle is fixed so that while the hand driven arm is being pivoted back and forth during exercise the handle will move in and out in an axial direction along the hand driven assembly. Means are provided for adjustably applying friction at the pivot hinge to allow the user to create the desired amount of resistance. The device may alternatively be used to exercise deltoid and lateral muscles. This is accomplished by strapping the hand driven against a user's side and affixing the upper arm support platform to the user's upper arm. In this way, as the user's arm is moved away from his or her body, the user's deltoid muscle is exercised and conversely, as the arm is brought back toward the body the user's lateral muscles are exercised. Preferably, the means for adjustably applying friction includes an elastomeric member within a sleeve. The elastomeric member may be compressed or adjustably released to provide more or less resistance against a sleeve at the pivot hinge.

DESCRIPTION OF THE PREFERRED EMBODIMENTS

Figure 1:
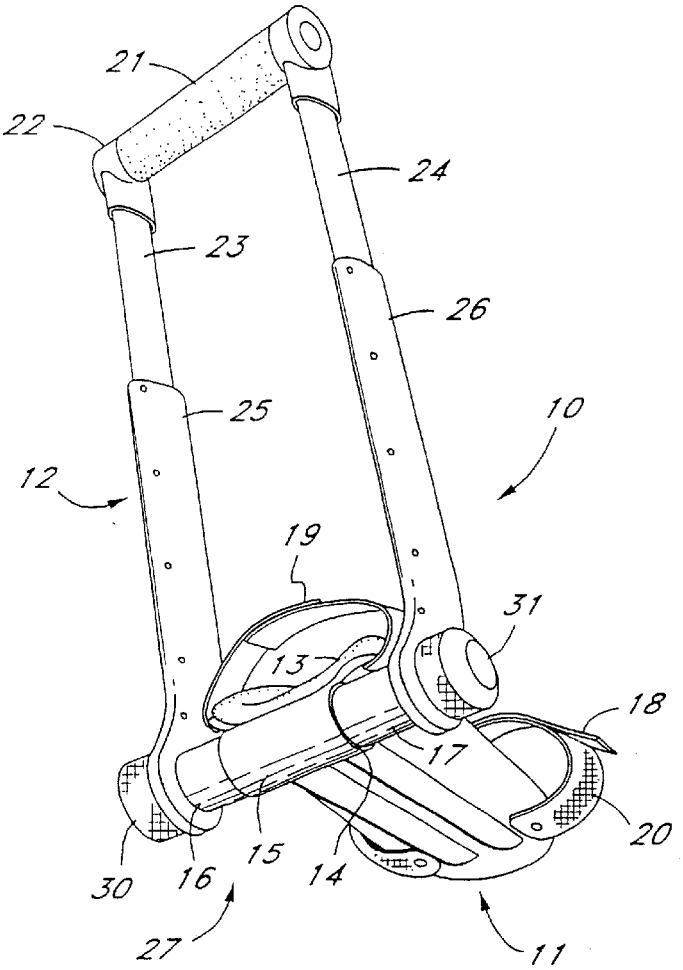
FIG. 1 is a perspective view of the arm exercising device of the present invention showing the top of an upper arm support platform and the bottom of a hand driven assembly.

The arm exercising device of the present invention is shown in perspective view in FIG. 1 and indicated generally by reference character 10. The device has an upper arm support platform 11 (referred to herein as a first part) which is pivotally attached to a hand driven assembly (referred to herein as a second part). The first part 11 and the second part 12 turn with respect to each other at a friction assembly creating a resistance to turning. The upper arm support platform has a pivot end 13 and the hand driven assembly has a platform attaching end 14. Pivot end 13 includes a pivot sleeve 15 which is located adjacent pivot end collars 16 and 17.

Upper arm support platform 11 has a pair of straps 18 and 19 which include conventional Velcro fasteners 20.

Figure 2:
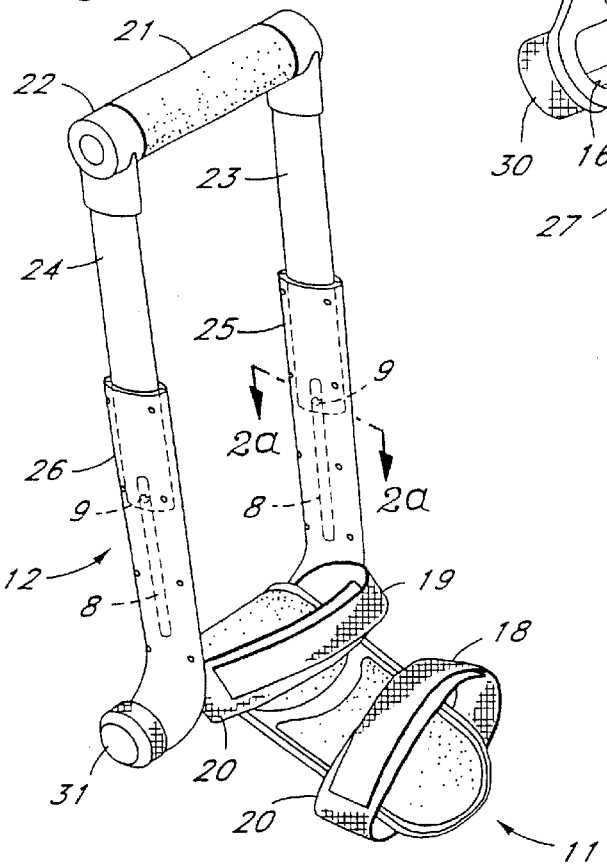
FIG. 2 is a perspective view of FIG. 1 showing the top of the platform and the top of the hand driven assembly thereof.
Figure 2A:
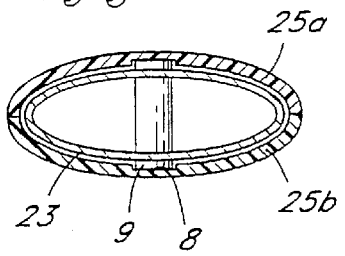
FIG. 2*a* is a cross-sectional view taken along line 2*a*—2*a* of FIG. 2.
Figure 3:
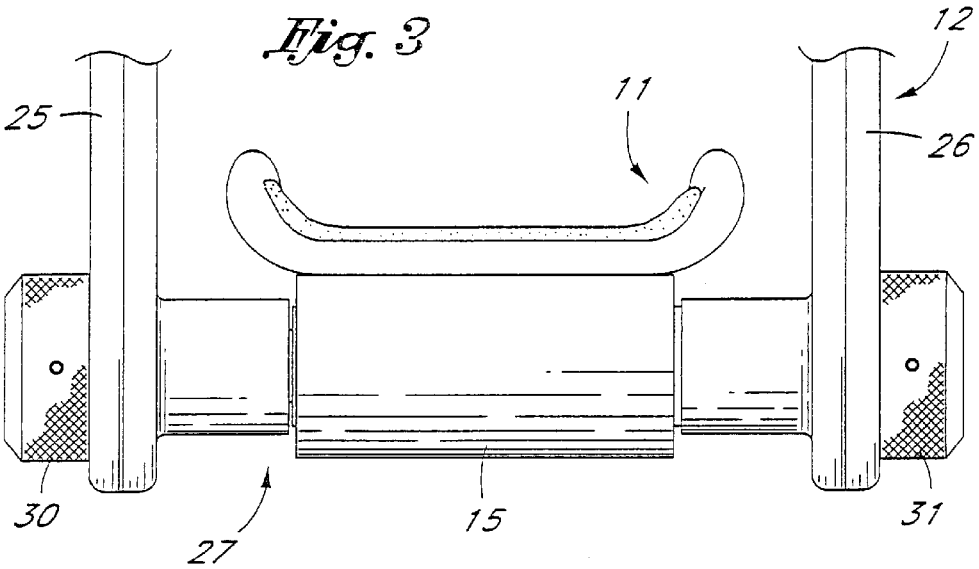
FIG. 3 is an enlarged end view of the upper arm support platform of the arm exercising device of FIG. 1 and showing the bottom of the pivot end of the hand driven assembly thereof.

The hand driven assembly 12 has a handle 21 at a hand grasping end 22 thereof. The handle is attached to the ends of piston rods 23 and 24 which slide in and out along elliptical tube assemblies 25 and 26. Piston rods 23 and 24 are preferably elliptical to provide maximum strength in the direction of the commonly applied forces. The handle 21 preferably is constructed as a foam covered sleeve which can freely rotate over a shaft not shown. As shown in FIG. 2*a*, a roll pin 9 rides in a pair of grooves 8 in elliptical tube assemblies 25 and 26 which limits the travel of the handle.

Figure 4:
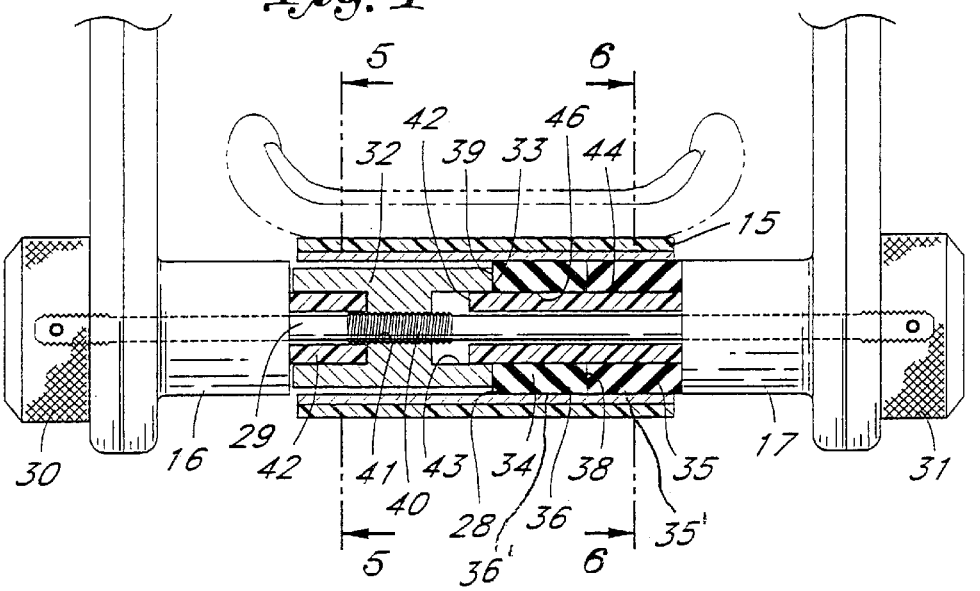
FIG. 4 a view analogous to FIG. 5 except that the sleeve portion thereof is shown in cross-sectional view.
Figure 5:
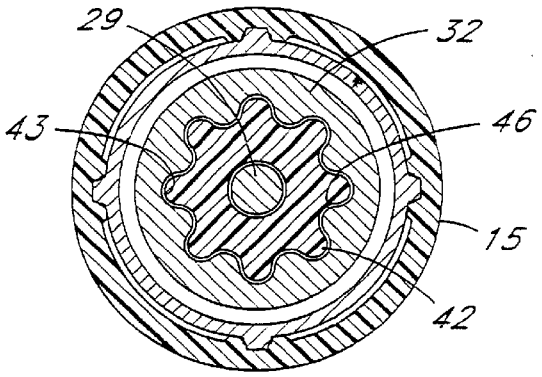
FIG. 5 is a cross-sectional view taken along line 5—5 of FIG. 4.
Figure 6:
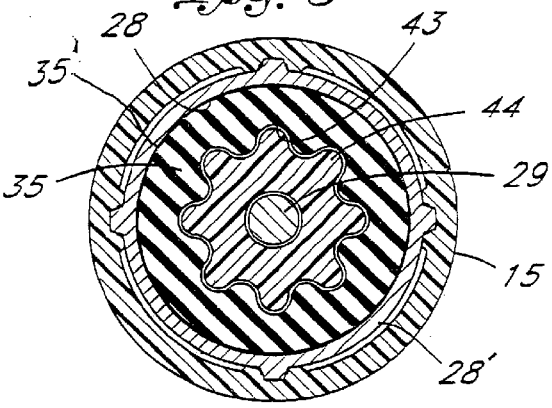
FIG. 6 is a cross-sectional view taken along line 6—6 of FIG. 4.

The upper arm support platform 11 and the hand driven assembly 12 are interconnected at a pivot hinge 27 and as shown best in FIG. 4. In FIG. 4, the pivot sleeve 15 is shown and has a cylindrical opening 28. While the opening is shown as cylindrical it could, of course, be slightly domed or slightly hourglassed and, thus, is referred to herein as a "generally cylindrically shaped opening" 28. This opening surrounds an axle pin 29 which is secured to knobs 30 and 31. The cylindrical opening 28 preferably includes an aluminum sleeve 28' spaced from pivot sleeve 15 and held by four tabs so that heat generated by friction is insulated from sleeve 15. The knobs may be turned to turn axle pin 29 in pivot collars 16 and 17 and within sleeve 15.

By turning either knob 30 or 31 the resistance force of friction to the movement of the upper arm support platform 11 and the hand driven assembly 12 is increased or decreased. This is carried out by the movement of a piston 32 which has a piston face 33. Piston face 33 abuts one of two elastomeric ring members 34 and 35. Although two elastomeric ring members 34 and 35 are shown, a single elastomeric ring could also perform this function. As the piston face presses against these ring members their outer surfaces 36 and 37 press against the cylindrical opening 28 in the aluminum sleeve 28' within pivot sleeve 15 and cause friction to movement of the elastomeric ring members 35 and 36 with respect to pivot sleeve 15. A ring expansion pressure is exerted against the end surfaces 38 and 39 of ring members 35 and 34 by the horizontal movement of piston 32. This horizontal movement is carried out by the turning of threaded sleeve 40 within a threaded opening 41 of piston 32. Piston 32 is secured against turning with respect to pivot end collar 16 and 17 by two gears 42 which comprises members with gear-shaped openings 43 formed in both ends of piston 32. Thus, piston 32 can move in or out in pivot sleeve 15 but cannot turn with respect to pivot end collars 16 and 17 and thus with respect to hand driven assembly 12. Elastomeric ring members 35 and 36 are similarly shaped so that they lock with gear 44 which interlocks with the inner surfaces 45 and 46 of ring members 35 and 34.

Figure 7:
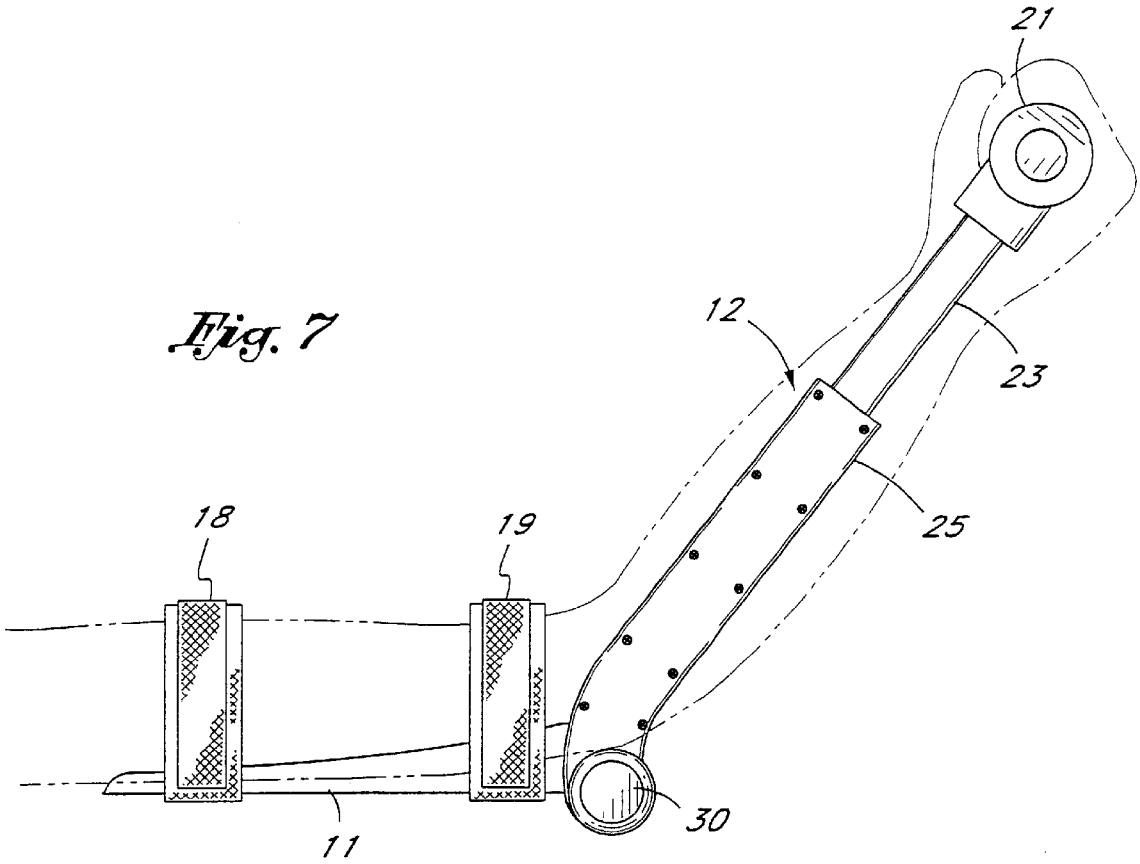
FIG. 7 is a side view of the arm exercising device of FIG. 1 showing a user's arm in phantom view.
Figure 8:
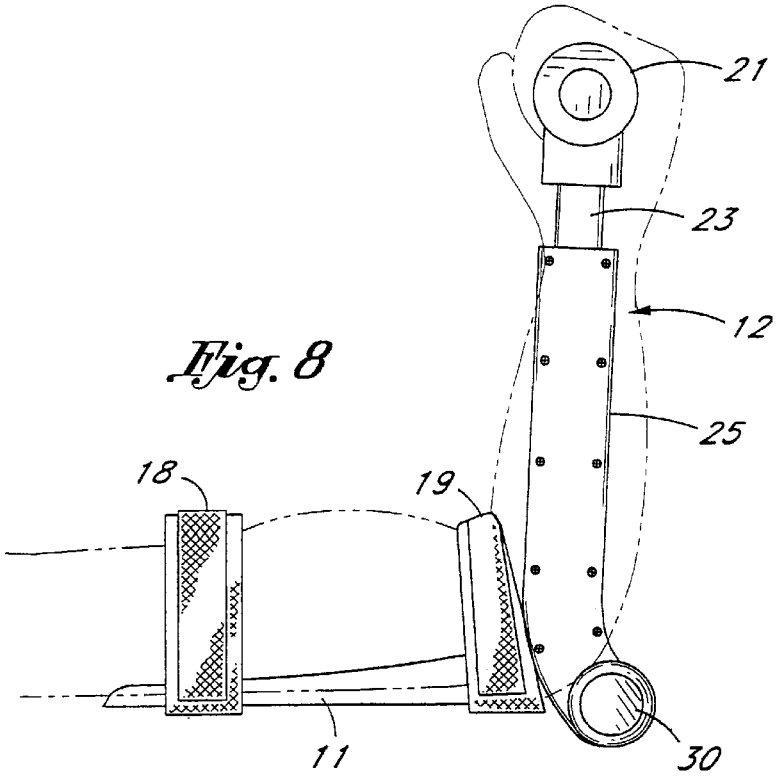
FIG. 8 is a side view analogous to FIG. 5 except that the user's arm is somewhat contracted.

In use, the user straps upper arm support platform 11 to his or her upper arm by securing straps 18 and 19 around the user's bicep and under the user's upper arm adjacent the user's tricep. The user's hand grasps handle 21 and knob 30 is turned to create the desired amount of friction. Of course, as the piston moves away from ring members 34 and 35, the friction force decreases. As shown by comparing FIGS. 7 and 8 the handle moves axially along the hand driven assembly 12 and it moves in and out along elliptical tube assemblies 25 and 26. This movement is essentially free and without substantial friction so that the exercise action is provided solely by the friction applied within sleeve 15.

Ring members 34 and 35 are preferably fabricated from a urethane elastomer because of its high resistance to abrasion. The remaining portions of the device may be fabricated from polyvinyl chloride, although the piston 32 is preferably made of a metal as, of course, is axle pin 29 and threaded collar 40.

Figure 9:
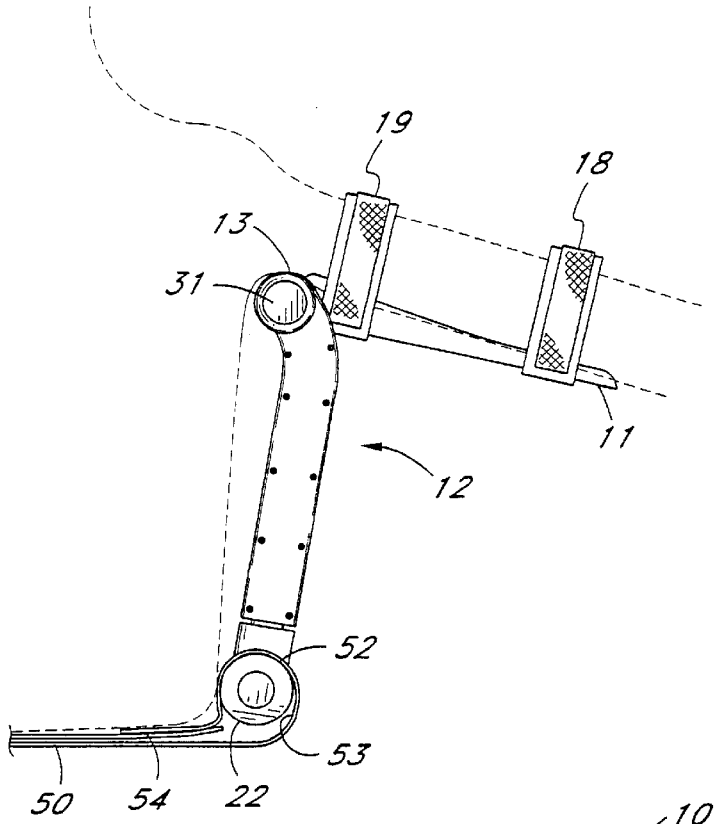
FIG. 9 is a side view of the arm exercising device of FIG. 1 configured to exercise a user's deltoid and lateral muscles showing a portion of a user in phantom view.
Figure 10:
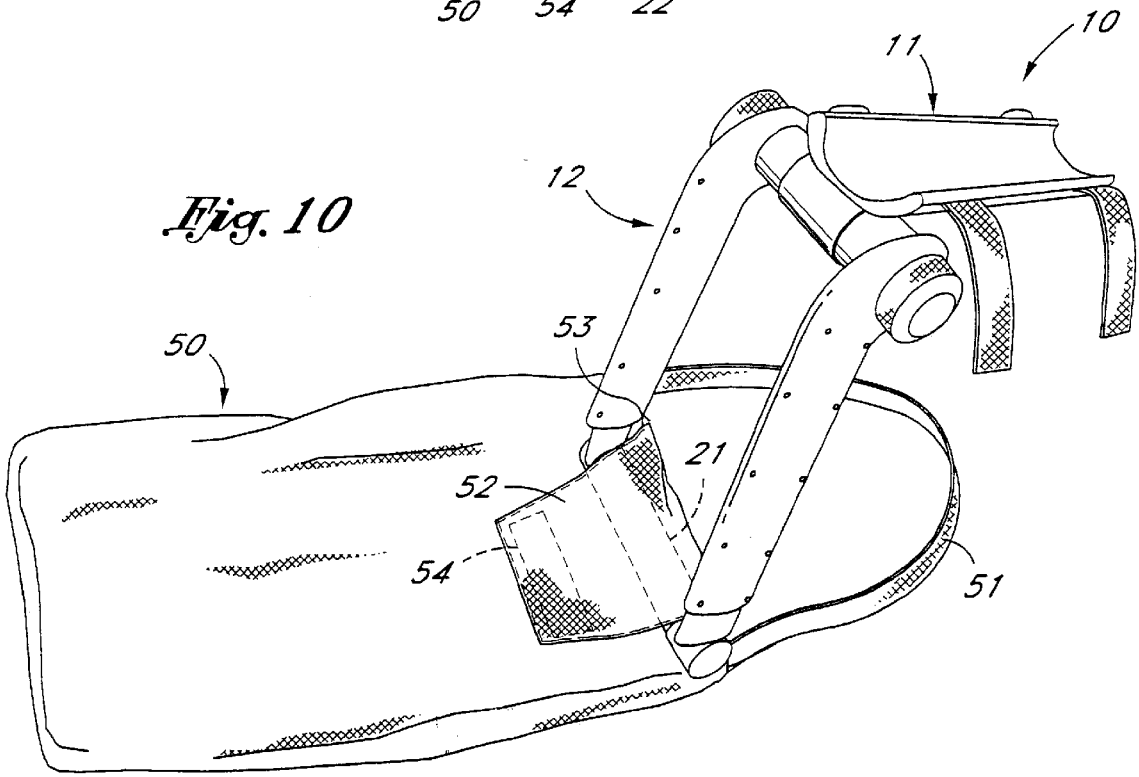
FIG. 10 is a perspective view of the arm exercising device of the present invention held by a carrying/handle-holding bag.

An important benefit of the exercising device of the present invention is that it can also be used to exercise the user's deltoid and lateral muscles as indicated in FIG. 9. A carrying bag 50 can be used to hold the device against a user's side. Bag 50 has a bag handle 51 and a cover 52. The cover 52 can be wrapped around the handle 21 and secured by Velcro 54, one-half of which is on the inner edge of cover 52 and the other half of which is on the outer surface of bag 50. Then the user sits on bag 50 with the loop 53 form in the cover 52 securing the handle 21 against the user's side. Then as the user moves his arm upwardly and downwardly, the user's deltoid muscle is exercised during an upward movement and the user's lateral muscles are exercised during a downward movement. Once again, knobs 30 or 31 may be turned to increase or decrease the friction. It is highly advantageous that both knobs turn since it would be very difficult for a user to turn a knob on the rear side as viewed in FIG. 9.

Thus, the exercising device of the present invention is highly compact, easy to use, relatively light weight and usable by men or women. It also is versatile in that it can exercise not only the user's biceps and triceps, but can be affixed in a different position to exercise a user's deltoid and lateral muscles.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. An-exercise device having a first part (11) and a second part (12) which turn with respect to each other at a friction assembly, a user interface connected to each of said parts, said friction assembly comprising:

an outer cylinder (28') affixed to first part (11), said outer cylinder (28') having an inwardly facing cylindrical friction surface (28);

at least one elastomeric ring (35,36) affixed to said second part (12), said elastomeric ring (35,36) having an outwardly facing cylindrical ring surface (35',36') adjacent said inwardly facing cylindrical friction surface (28) and said elastomeric ring (35,36) being in a confined space and having two outwardly facing end surfaces (38,39); and means for adjustably compressing said at least one elastomeric ring (35,36) from an outwardly facing end surface of said elastomeric ring (35,36), thereby compressing said at least one elastomeric ring (35,36) and distorting it thereby urging said outwardly facing cylindrical ring surface (35',36') outwardly against said inwardly facing cylindrical friction surface (28), thereby increasing a resistance movement between said cylindrical ring surface (35',36') and said cylindrical friction surface (28), so as to generate friction for said exercise device.

2. The exercise device of claim 1 wherein said elastomeric ring is fabricated from a urethane elastomer.

3. The exercise device of claim 1 wherein said outer cylinder is fabricated from aluminum.

4. The exercise device of claim 1 wherein said elastomeric ring (35,36) is affixed to said second part by a member (44) having a non-circular peripheral shape supported by said second part (12), which member (44) is located within in said elastomeric ring (35,36), and said elastomeric ring has an inner surface (43) shaped to mate with non-circular peripheral shape of said member (44), whereby said elastomeric ring (35,36) turns with said second part.

5. The exercise device of claim 4 wherein said non-circular peripheral shape has a plurality of gear teeth thereon.

6. The exercise device of claim 5 wherein said non-circular peripheral shape has eight gear teeth.

7. The exercise device of claim 4 wherein said means for adjustably compressing at least one elastomeric ring (35,36) from an outwardly facing end surface (38,39) thereof comprises a shaped piston (32) which has an outer peripheral shape which freely fits within said outer cylinder (28') and said shaped piston (32) having a non-circular peripheral inner shape (43) which fits over said member and wherein said shaped piston (32) is externally adjustable to exert a greater or lesser force against said outwardly facing end surface (38,39) of said at least one elastomeric ring (35,36).

* * * * *